United States Patent [19]

Holmes

[11] Patent Number: 4,802,310

[45] Date of Patent: Feb. 7, 1989

[54] SANDER ATTACHMENT

[76] Inventor: Robert W. Holmes, P.O. Box 244, The Sea Ranch, Calif. 95497

[21] Appl. No.: 147,539

[22] Filed: Jan. 25, 1988

Related U.S. Application Data

[63] Continuation-in-part of Ser. No. 8,477, Jan. 29, 1987, abandoned.

[51] Int. Cl.[4] ..... B24B 23/00

[52] U.S. Cl. ..... 51/170 MT; 51/372; 51/241 B; 15/233

[58] Field of Search ..... 51/358, 170 EB, 170 MT, 51/372, 241 R, 241 B, 371, 392, 393, 390, 367, 381, 382, 389; 15/231, 233, 209 R, 208

[56] References Cited

U.S. PATENT DOCUMENTS

| | | | |
|---|---|---|---|
| 1,588,160 | 6/1926 | Booty | 15/233 |
| 2,132,889 | 10/1938 | Ayres | 15/233 |
| 2,848,850 | 8/1958 | Metoff | 51/170 MT |

FOREIGN PATENT DOCUMENTS

| | | | |
|---|---|---|---|
| 830733 | 5/1938 | France | 15/233 |

*Primary Examiner*—Frederick R. Schmidt
*Assistant Examiner*—Maurina Rachuba
*Attorney, Agent, or Firm*—Cahill, Sutton & Thomas

[57] ABSTRACT

Attachment for an oscillating sander to facilitate sanding convex surfaces. A rigid U-shaped frame carries an elastic strap to which an inelastic abrasive sheet is adhered. The abrasive sheet has a contact adhesive thereon which is capable of adhering to, releasing from, and re-adhering to the elastic strap as the sheet is oscillated over a work surface.

3 Claims, 1 Drawing Sheet

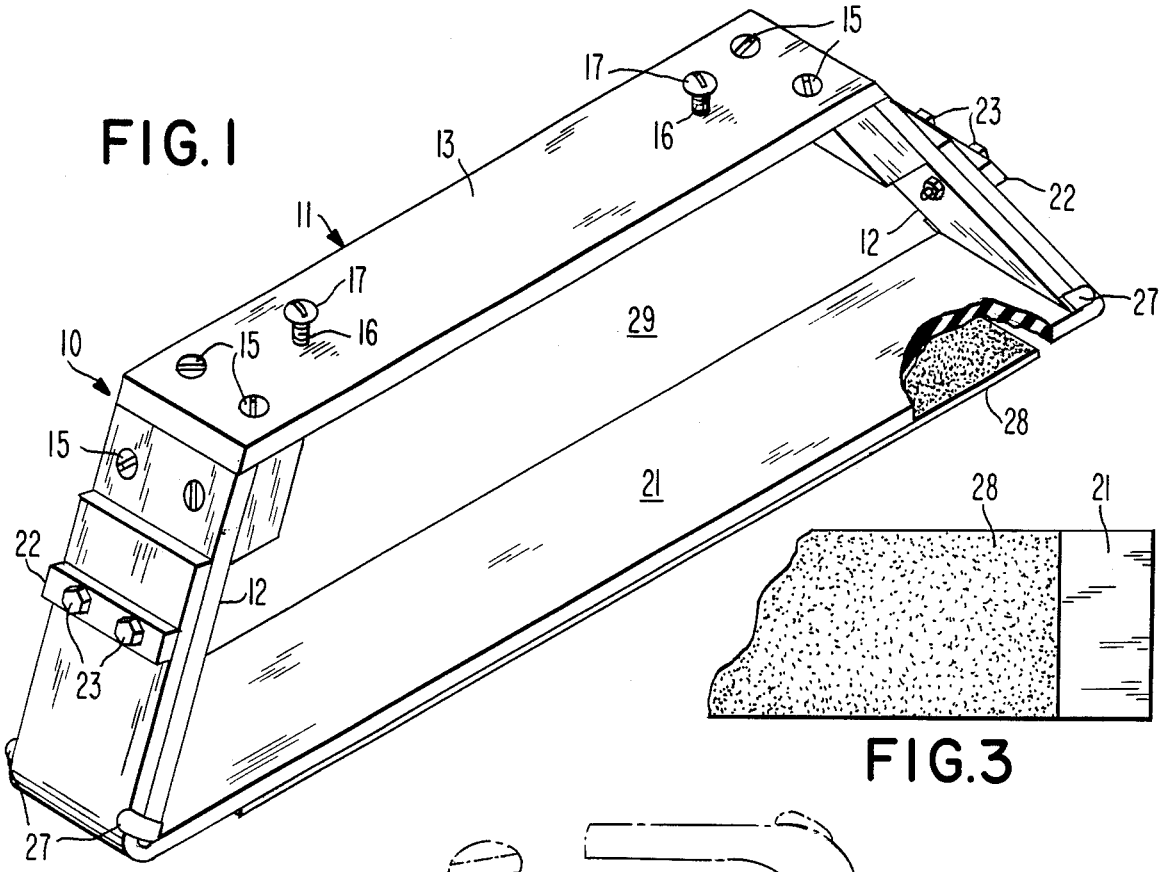
FIG. 3
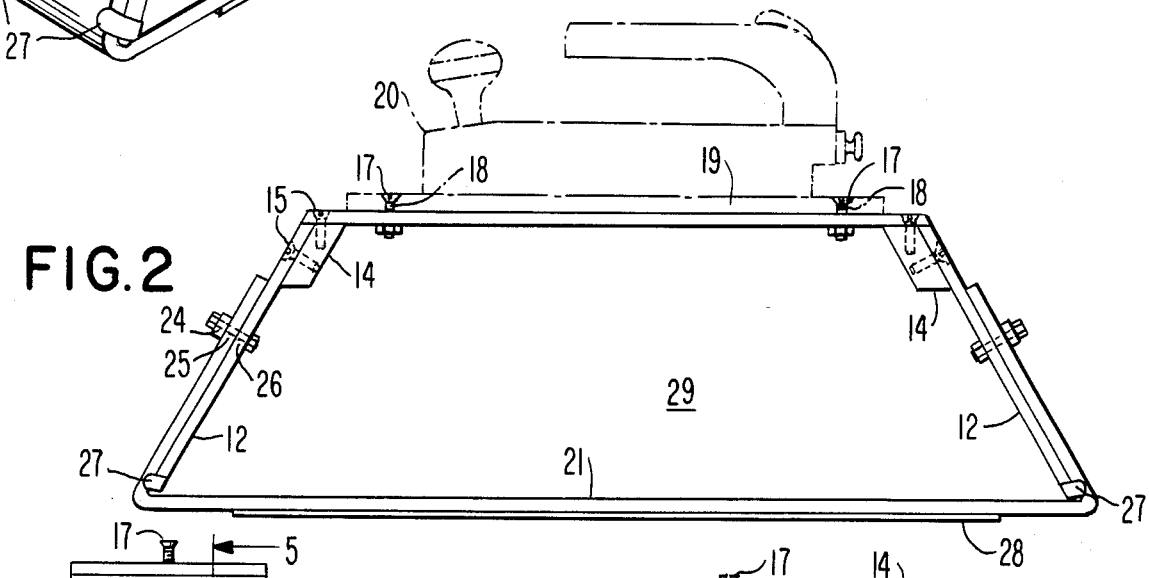
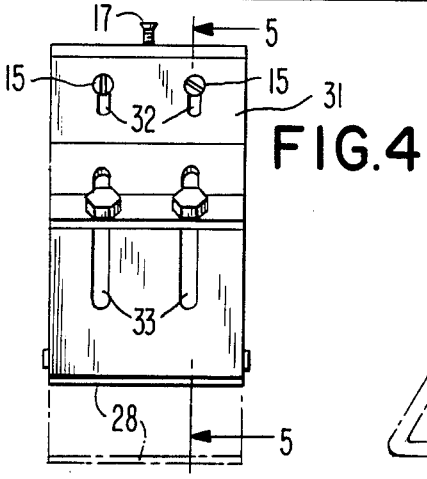
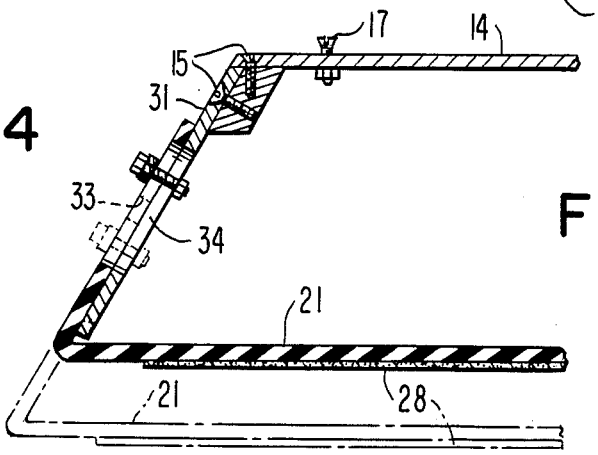

SANDER ATTACHMENT

This application is a continuation-in-part of application Ser. No. 07/008,477, filed Jan. 29, 1987 and entitled "VARI-CURV SANDER ATTACHMENT", now abandoned.

TECHNICAL FIELD

This invention relates generally to sanding tools. More specifically, it relates to sanding tool accessories which are used in sanding curved surfaces.

BACKGROUND ART

It is well known to those persons who are experienced in the field of sanding curved surfaces, such as automobile body workers restoring a fender curve, that it is difficult to prevent getting flat spots when working with a conventional oscillating sander. This problem is also encountered in other fields, such as when trying to sand-finish convex surfaces of three-dimensional sculpture work made from various materials.

Prior inventors have devised hand-held polishing and buffing implements with flexible polishing surfaces for curved objects, such as fingernails. Examples of such implements can be found in U.S. Pat. Nos. 1,588,160, granted June 8, 1926 to P. C. P. Booty for "POLISHING IMPLEMENT AND POLISHING STRIP THEREFOR", and 2,132,889 granted Oct. 11, 1938 to E. Ayres for "FINGERNAIL BUFFER" and French Pat. No. 830,733 granted Aug. 8, 1938 for "POLISSOIR". None of these implements is suitable for use in conjunction with a powered oscillating sander because each utilizes a flexible or articulated frame for supporting an inextensible polishing band. The constructions are such that the oscillations of a sander cannot be transmitted to the polishing band.

DISCLOSURE OF THE INVENTION

Accordingly, it is a principal object of the present invention to provide an attachment to an oscillating type sander for sanding curved surfaces to greater accuracy and precision. The attachment comprises a ridig, U-shaped frame supporting an elastic strap, one face of which carries an abrasive sheet that deforms to assume the shape of a curved surface against which it is applied. Thus, when applied to compound convex curved surfaces, the abrasive sheet automatically assumes each different curvature as it passes thereacross. This prevents forming flat spots on the curved surfaces.

Another object is to provide a sander attachment which is adjustable in length so that a complete range of curves may be sanded, anywhere from a very sharp curve to an almost flat face.

Other objects are to provide a sander attachment which is simple in design, inexpensive to manufacture, easy and quick to attach and use on an oscillating sander and is practical.

BRIEF DESCRIPTION OF THE DRAWINGS

FIG. 1 is a perspective view of a sander attachment embodying the present invention;

FIG. 2 is a side elevational view of the sander attachment;

FIG. 3 is a fragmentary bottom view of the attachment;

FIG. 4 is a side elevational view of a sander attachment representing another invention; and FIG. 5 is a fragmentary cross-sectional view taken along line 5—5 of FIG. 4.

BEST MODE FOR CARRYING OUT THE INVENTION

Referring now to the drawing in greater detail, and particularly to FIGS. 1 to 3 thereof, the reference numeral 10 generally identifies the sander attachment incorporating the invention. The attachment 10 includes a generally U-shaped frame 11 that includes a pair of diverging legs 12 at opposite ends of an intermediate bar 13. The bar and legs of the frame are preferably made from separate flat sheet metal members, which are fastened together by blocks 14 and screws 15 at the corners of the frame. The frame members are constructed of steel or aluminum sheet of sufficient thickness to render the frame 11 substantially rigid.

The bar 13 is adapted to be fastened to a powered sander and for this purpose includes a pair of spaced apart openings 16 for receiving bolts 17 inserted through openings 18 in the oscillating base plate 19 of the sander 20.

A stretchable, elastic strap 21 of rubber or rubber-like material is fastened at its opposite ends to each one of the legs 12. The fastening means on each leg preferably comprises an aluminum block 22 and a pair of bolts 23 inserted through openings 24 in the block, openings 25 through the strap and openings 26 through the leg. The strap extends around the terminal outer end of each leg and lays against the leg outer side. A tab 27 at each said edge of the leg end guides the strap and prevents it from sliding off the frame 10 during use.

A strip of inelastic abrasive sheet material 28, such as sandpaper, is adhered to the underface of the portion of strap 21 extending between the legs 12. The back, or upper face, of sheet 28 is coated with a contact adhesive capable of being adhered to, released from and re-adhered to the elastic strap 21.

In use, with the sander 20 turned on, the attachment 10 oscillates together with the sander base plate so that the abrasive sheet 28 oscillates over the surface of the work. The elastic strap 21 stretches the flexes inwardly into the area 29 between the legs according to the particular convex curvature contour of the work as pressure is applied to the sander and the attachment 10. It is to be noted that since the abrasive sheet 28 cannot stretch, as does the elastic strap 21, the sheet 28 becomes partially detached and then partially reattached to the strap as the attachment is moved between surfaces having different degrees of curvature. The adhesive assures that there will be sufficient attachment between the strap 21 and sheet 28 to oscillate the sheet 28 over the surface of the work.

In a modified design of sander attachment 30, shown in FIGS. 4 and 5, the legs 31 may be made to be selectively extendable, so that a more complete range of curves may be sanded from very sharp to almost flat. This is accomplished by slots 32, instead of circular openings receiving the screws 15, thus permitting the length of the legs 31 to be adjusted.

Alternately, as also shown in FIGS. 4 and 5, slots 33 in the strap and slots 34 in the legs, substitute for the openings 25 and 26 respectively, to permit adjustment of the tension in elastic strap 21.

While various other changes may be made in the detail construction, it is understood that such changes will be within the spirit and scope of the present invention, as is defined by the appended claims.

What is claimed is:

1. The combination with a power sander having an oscillating base plate of an attachment for sanding curved surfaces, said attachment comprising a substantially rigid frame comprising an intermediate bar and legs depending from opposite ends of the bar, means for attaching said intermediate bar to the base plate of the sander, a stretchable elastic strap secured to said legs, said elastic strap being stretchable to move up into the space between said legs when the strap is pressed against a curved surface, and a substantially inelastic sheet of abrasive material carried by said strap, said inelastic sheet having a contact adhesive thereon which is capable of being detached from and reattached to said strap during oscillation of said frame by the sander.

2. The combination of claim 1 further characterized in that at least one of said legs is adjustable as to length.

3. The combination of claim 1 further characterized in that said frame includes means for adjusting the tension in said elastic strap.

* * * * *